United States Patent [19]

Koch

[11] 4,031,339

[45] June 21, 1977

[54] MODULAR TIME SEQUENCE CONTROLLER

[75] Inventor: Claude V. Koch, Two Rivers, Wis.

[73] Assignee: AMF Incorporated, White Plains, N.Y.

[22] Filed: Dec. 15, 1975

[21] Appl. No.: 640,990

[52] U.S. Cl. ..... 200/38 BA; 200/31 R; 200/38 R; 200/153 LB; 200/153 T; 200/293

[51] Int. Cl.[2] ..... H01H 43/10; H01H 9/02

[58] Field of Search ..... 200/27 B, 31 R, 38 R, 200/38 B, 38 BA, 38 C, 38 CA, 153 L, 153 LA, 153 LB, 153 T, 293–296, 307; 74/567, 568 R, 568 T, 568 M

[56] References Cited

UNITED STATES PATENTS

| | | | |
|---|---|---|---|
| 3,221,117 | 11/1965 | Simmons | 200/38 BA |
| 3,325,609 | 6/1967 | Otterlei | 200/38 BA |
| 3,470,335 | 9/1969 | Roberts | 200/38 CA |
| 3,569,992 | 3/1971 | Papa, Jr. et al. | 200/38 BA |
| 3,678,225 | 7/1972 | Hulterstrum | 200/38 BA |
| 3,821,503 | 6/1974 | Homan et al. | 200/293 X |
| 3,846,597 | 11/1974 | Ziegler, Jr. | 200/38 CA X |
| 3,852,542 | 12/1974 | Rogers et al. | 200/38 BA X |

*Primary Examiner*—James R. Scott
*Attorney, Agent, or Firm*—George W. Price; John H. Gallagher

[57] ABSTRACT

A modular time sequence controller having multiple timing cams and switches. Modules of switches and cams may be added and removed without disturbing other modules. Clip means for retaining a switch in a module facilitates easy insertion and removal without disturbing other elements of the assembly.

8 Claims, 4 Drawing Figures

MODULAR TIME SEQUENCE CONTROLLER

BACKGROUND OF THE INVENTION

The present invention relates to electromechanical apparatus which commonly is called an automatic program controller, repeat cycle timer and time sequence controller or programmer. Apparatus of this type is well known and is comprised of a plurality of cams or drums mounted on a common axle which is rotated by a synchronous motor. An electrical switch is mounted in proximity to each cam or drum and each switch controls an independent circuit, or respective subcircuit of a system. Typically, the cams or drums are independently adjustable in order that the ON and OFF times of the respective switches may be independently programmable as a function of the physical adjustment of a camming surface or the placement of switch actuator means on the individual rotatable cam or drum.

Apparatus of this type has found wide and diverse use in industry and it is desirable that it be constructed in such a way as to be readily adaptable to the diverse applications to which it may be put. For example, the number of independent circuits or subcircuits to be controlled may vary considerably with different users, and the number of required circuits may change from time to time with one user. Additionally, the power requirements of the various circuits to be controlled may be different so that switches of different power handling capabilities may be required in one time sequence controller. Furthermore, for the apparatus to be of optimum flexibility and utility, it is desirable that switches and switch actuator means be easily added, replaced and removed from the apparatus with a minimum of effort and with a minimum investment in component parts. Commonality of parts thus is an important factor in minimizing cost and effort.

Past attempts to overcome some of the deficiencies and to achieve some of the advantages mentioned above have resulted in modular construction of time sequence controllers. In this type of construction the switch and switch actuating means such as a cam or drum assembly are manufactured in such a way that one switch and one actuator means may be assembled as a modular unit and then a plurality of modules assembled together to comprise a completed multiswitch controller assembly. U.S. Pat. Nos. 3,470,335, 3,569,992 and 3,678,225 are representative of past efforts. However, some of the apparatus shown in the mentioned patents is rather complicated and expensive to manufacture, and other apparatus does not have the desired degree of flexibility and commonality of modular parts. One deficiency in the known prior art is that the assembled modules are held together by a common fastening means such as a long tie rod that passes through all the modules and is bolted to end plates at opposite ends of the assembled modules. To add or remove modules, the common tie rod must be withdrawn and replaced by one of a different length. This requires that a number of tie rods of different lengths must be maintained in stock to afford flexibility in the number of modules that may be assembled. When a tie rod is withdrawn to add or remove modules, or when the bolts of the tie rod are loosened to allow replacement of an independently housed switch, the switches and possibly other parts of the assembly may become displaced or misaligned, thus adding to the complexity of reassembling the modules.

The apparatus of the present invention overcomes the above problems by providing relatively simple and economically manufactured component parts having a very high degree of commonality. Additionally, modules may be added, removed and changed with a minimum of effort and without appreciably affecting other modules of the assembly.

DETAILED DESCRIPTION OF A PREFERRED EMBODIMENT

Figure 1:
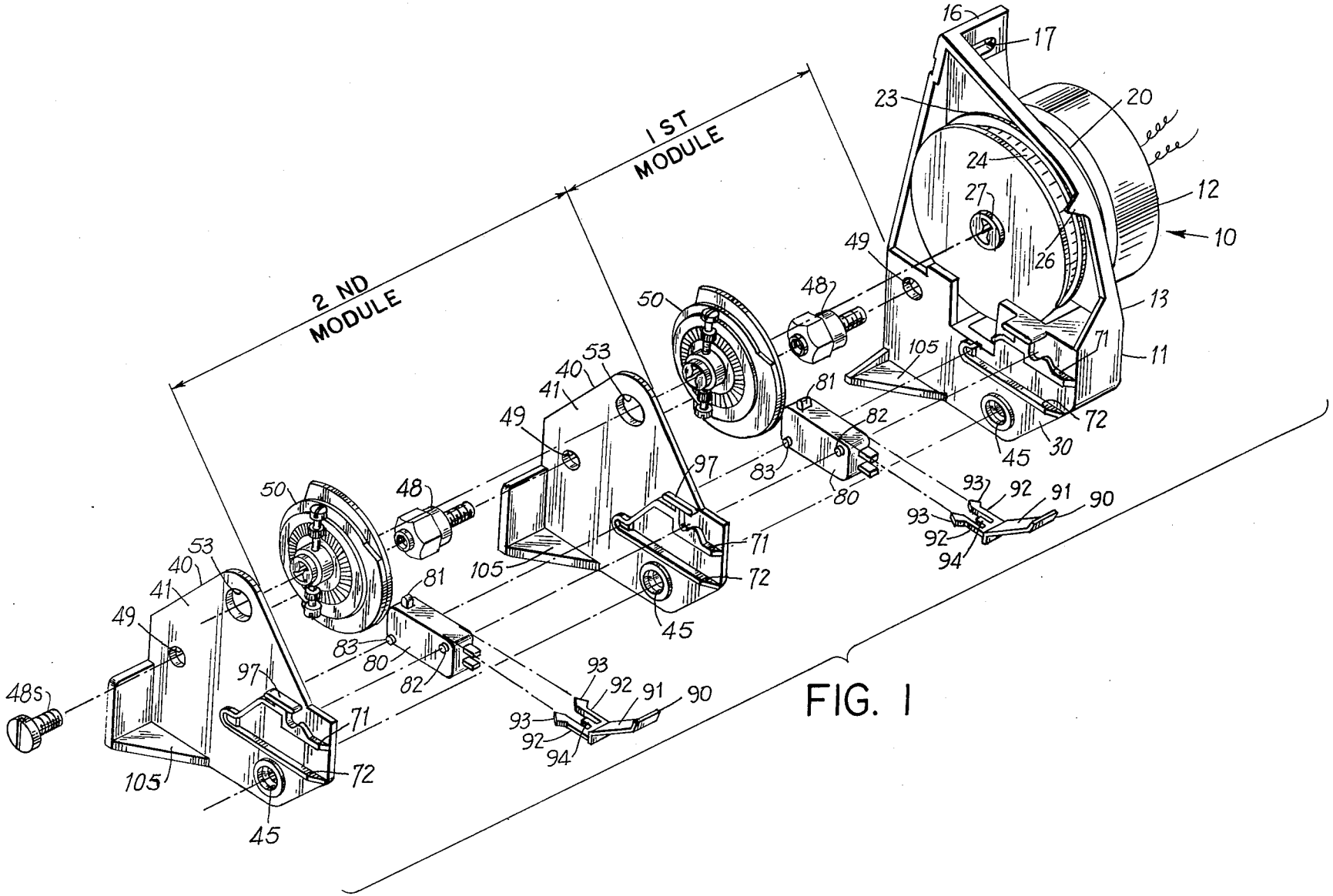
FIG. 1 is an exploded view of a modular time sequence controller of the present invention.

The modular time sequence controller of this invention is shown in an exploded view in FIG. 1. To simplify the drawings and description, just two modules are illustrated and described. Additional modules may be added to the left of the assembly illustrated in FIG. 1. Any added modules will be identical to the module illustrated on the left of FIG. 1. The first module illustrated on the right of FIG. 1 is substantially identical to all subsequent modules, except that there are minor structural differences to make the first module compatible with a motive means 10 which supplies power for rotating timing cams in all modules. Because commonality of parts is a feature of the modular construction of this invention, the same part of each illustrated module will be identified by the same reference numeral, with the necessary exceptions being noted with regard to any unique features that are included with the motive means 10 and which comprise portions of the first module.

Motive means 10 includes a mounting bracket 11 for mounting a synchronous timing motor 12 on the outside face 13 thereof. Bracket 11 includes a flange 16 at a right angle to face 13. Flange 16 has mounting holes 17 therein for fixedly mounting the bracket to a stationary support.

As is conventional, timing motor 12 includes a gear reduction mechanism 20 having an output spur gear (not illustrated) which rotates at a predetermined fraction of the rotation of motor 12. The spur gear engages a gear track on the periphery of a large driven gear 23 which is mounted for rotation in a bushing on mounting bracket 11. A setting drum 24 having a dial about its circumference is coupled to driven gear 23 by means of a one way clutch (not illustrated) located within setting drum 24. One way clutches for use in timing devices are well known to those skilled in the art and sometimes are called ratchet clutches and overriding clutches. An indicating pointer 26 on mounting bracket 11 is used in the setting of the timing cams, as will be explained below.

An axial rotating shaft 27 extends outwardly from the face of setting drum 24. The outward end of shaft 27 has axle interlock means thereon for effecting a quick and simple interlock with the end of another axle, as will be described in more detail below.

Mounting bracket 11 includes on its lower left side, as viewed in FIG. 1, a partial support plate 30 which is parallel to the face 13 and spaced therefrom by supporting web members. Mounting bracket 11 preferably is a molded plastic member having all structural elements moulded as a unitary structure.

An assembled time sequence controller includes a plurality of parallel and spaced apart support plates 40, the number being determined by the number of switch modules that are required for the particular application of the user. The support plates 40 are identical and interchangeable and are moulded from a suitable thermosetting plastic material.

Figure 2:
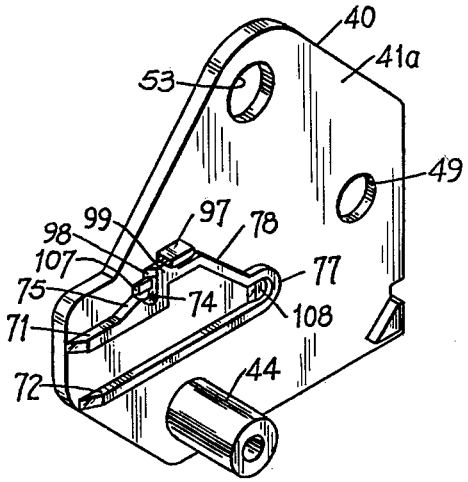
FIG. 2 is a view of a face of a support plate of the modular assembly.

Considering the plastic support plates 40 in more detail, as well as the partial support plate 30, one side surface 41 of each plate is illustrated in FIG. 1. It is seen that the illustrated side surfaces 41 are identical and that the partial support plate 30 on mounting bracket 11 is substantially identical to the corresponding lower portions of the full support plates 40. The opposite side surface 41*a* of each support plates 40, which cannot be seen in FIG. 1, is illustrated separately in FIG. 2. As seen in FIG. 2, a spacer rod 44 is molded as part of the support plate and extends perpendicularly from face 41*a*. In its assembled relationship, the free end of spacer rod 44 is received in a circular boss 45, FIG. 1, molded on the face 41 of the adjacent support plate 40. The length of spacer rod 44 establishes the axial spacing between support plates, including partial support plate 30.

Spacer and fastening bolts 48 also maintain the support plates, and partial support plate 30, in spaced parallel relationship. The right end of each spacer and fastening bolt 48 is of reduced diameter and is externally threaded. This threaded end passes through an aperture 49 in the support plate to its right, as viewed in FIG. 1. The left end of each fastening bolt 48 is axially internally threaded to receive the externally threaded end of the fastening bolt from the next adjacent module on its left. The left end of each fastening bolt also has a raised coaxial boss which is received within the aperture 49 on a support plate.

In the first module which includes partial support plate 30, a nut, not illustrated, is threaded onto the externally threaded end of fastening nut 48 which extends through aperture 49 in partial plate 30. Only one such nut is employed in an assembly. Similarly, the endmost module requires a screw 48*s*, FIG. 1, which fastens the endmost support plate 40 to the fastening bolt 48 in that last module. Only one such screw 48*s* is employed in an assembly.

Figure 3:
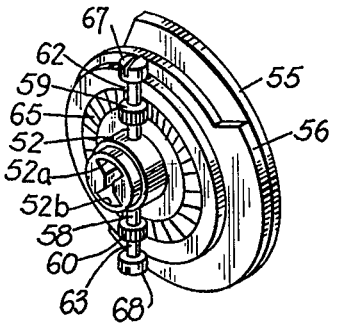
FIG. 3 is an enlarged view of one adjustable cam assembly used in each module of the assembly of FIG. 1.

An adjustable timing cam assembly 50 is mounted between each pair of support plates 40, including partial support plate 30. A timing cam is illustrated in greater detail in FIG. 3 and includes an axle 52 which has axle interlock means on each end thereof to permit the end of one axle to quickly and easily interlock with the end of an adjacent cam axle so that interlocked axles of assembled modules will rotate together. A number of quick connect interlocks are known and may be used. In this instance, the interlock means at one end of axle 52 is comprised of two recesses 52*a* and 52*b* which are symmetrically disposed about the axis of the axle, and the interlock means at the other end of the axle is comprised of two axially extending studs which are located and shaped to fit within the mating recesses on the end of an adjacent axle.

In FIG. 1, the end of axial shaft 27 on setting drum 24 is provided with one of the same interlock means so that the axle 52 of a cam assembly 50 may be interlocked with shaft 27. The left end of the axle of cam assembly 50 is rotatably supported in an aperture 53 in support plate 40. Other suitable bushing means may be provided in the place of simple aperture 53.

Returning to FIG. 3, timing cam 50 further includes first and second cam discs 55 and 56 which are rotatably supported with a somewhat snug fit on axle 52. The cam discs are identical and each has a high and a low portion about its peripheral edge. A hollow pinion shaft 58 extends transversely through axle 52 and is held by friction in a fixed position therein. Pinion gears 59 and 60 are on respective stems 62 and 63 which extend down into opposite ends of pinion shaft 58 and mate with a circular gear track 65 in the outer face of cam 56. The outer ends of stems 62 and 63 are provided with screw driver slots 67 and 68 to provide means for rotating the respective pinion gears 59 and 60. When either one of the pinion gears is caused to rotate, cam 56 will rotate about axle 52.

Cam 55 is identical to cam 56 and has associated with it a respective pinion shaft, pinion gears and a circular gear track as just described for cam 56. It may thus be seen that the cams 55 and 56 may be rotated independently about axle 52 to provide various desired combined lengths of high and low camming surfaces about the periphery of the cam assembly.

Returning now to FIGS. 1 and 2, the support plates 40 have molded on each face outstanding guide means or tracks 71 and 72. The guide means are parallel and extend from the periphery of the plate inwardly toward its center. The top guide means 71 terminates in a perpendicular stop 74 and has an upwardly protruding detent means 75 spaced slightly in front of stop 74. The bottom guide means 72 terminates in a U-shaped stop means 77 that is jointed to a sloping guide portion 78 which joins stop means 74. The partial support plate 30 on mounting bracket 11 also has molded thereon guide means identical to those just described.

Figure 4:
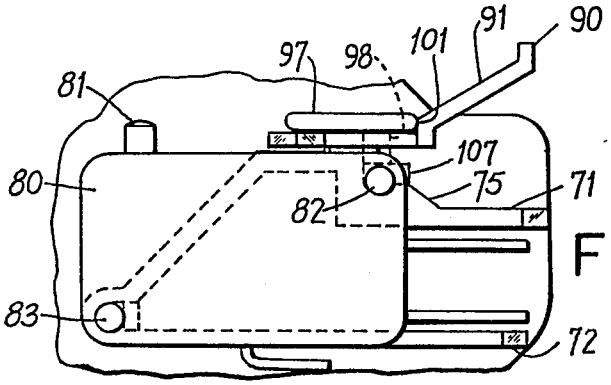
FIG. 4 is a plan view showing a switch seated within guide means on a face of a support plate.

The guide means just described are provided for guiding into position between a pair of support plates a switching means which is to be actuated by a respective cam assembly 50. As illustrated in FIGS. 1 and 4, the switching means is a precision snap switch 80 having an actuator button 81 extending upwardly out of the switch housing, and having its normally open and normally closed switch terminals extending from one end and its common terminal extending from the bottom of the housing. Switches of this type are commercially available with various ratings from a number of suppliers. Series A1 miniature precision snap-action switches manufactured by Potter & Brumfield Division of AMF Incorporated, Princeton, Indiana are suitable type switches. Snap switches of these types are manufactured with mounting holes which pass completely through opposite corners of the housing. For use in the apparatus of this invention, short solid metal rods are staked into the respective mounting holes with the two ends of each rod protruding outwardly from opposite sides of the housing so as to form followers 82 and 83.

When support plates 40 are fixed in spaced parallel relationship, a switch 80 may be inserted into position between adjacent plates by bringing followers 82 into sliding engagement with the top edges of guides 71 and the followers 83 into engagement with the top edges of guides 72. The switch then is pushed inwardly until followers 82 and 83 meet the stops 74 and 77 respectively. Follower 82 on the top of switch 80 will have passed over detent 75 and will come to rest in the recess between the detent and stop 74. When a switch 80 is in this position, the actuator button 81 is located proximate the periphery of its respective rotatable cam assembly 50 so that the actuator button 81 will be depressed by the high portion of the cam assembly.

It is necessary to precisely maintain the switch in the position described to assure that the switch is actuated at the same angular position of the cam surface on each revolution of the cam.

A plastic keeper clip 90, FIGS. 1 and 4, is provided to keep each switch 80 in its desired position. Keeper 90 is comprised of a holding tab 91 and a pair of yieldable legs 92 extending therefrom. Each leg has a barb 93 at its outer end. A wedging portion 94 is located between legs 92. The operation of wedging portion 94 will be described below.

A keeper 90 is wedged between each pair of parallel support plates 40, and between the first support plate 40 and the partial support plate 30 on mounting bracket 11. As best seen in FIGS. 2 and 4, each side of a support plate 40, and the partial plate 30 on mounting bracket 11, have keeper retaining means comprised of an outwardly extending guide 97 which is located above stop 74. Between guide 97 and stop 74 is an inclined surface 98 and a flat raised surface 99 which has a sharp drop off at its inwardmost edge.

A keeper 90 is inserted between two support plates 40 with the two yieldable legs 92 being urged inwardly by the inclined surfaces 98 on the facing surfaces of two support plates. The yieldable legs 92 then pass over the flat raised surfaces 99 until the barbs 93 at the ends of the legs engage the drop off at the far end of raised surface 99. A stop means 101 on keeper 90 then is in abutting contact with the outer end of guide means 97 to maintain keeper 90 in a locked, but removable, position above switch 80.

The wedging portion 94 located between legs 92 of each keeper 90 has a raised ridge or a wedge on its bottom surface (not illustrated) which is urged into firm contact with the top surface of the switch housing when keeper 90 is in its inserted position. The force exerted on the switch housing by wedging portion 94 of the keeper maintains the followers 82 and 83 in firm contact with their respective guide means and stops, and prevents the followers 82 on each side of the housing from moving from their positions between detent means 75 and stop 74. It will be seen that with keeper 90 in its inserted position switch 80 is effectively locked into its desired position proximate its respective cam assembly.

The arms 92 on keeper 90 are sufficiently yielding, and the barbs 93 are so shaped, that the keeper may be withdrawn from its inserted position with a moderate amount of force.

To add an additional module to the assembly illustrated in FIG. 1, screw **48*s* is removed and the externally threaded end of a fastening bolt 48 is passed through the aperture 49 in the end one of the already assembled support plates and is threaded into the internally threaded end of the last assembled fastening bolt 48. The axle interlocking means on a cam assembly 50 then is inserted into the mating interlocking means on the axle of the last one of the assembled cam axles. The opposite end of the new cam axle then is inserted in the axle bushing 53 on the new support plate 40. The new support plate then is aligned parallel to the assembled support plates with its plastic spacer rod 44 in registration with the circular boss 45 on the outer face 41 of the last one of the assembled plates. The apertures 49 in the new support plate is placed in registration with the circular raised boss on the end of fastening bolt 48, and the screw 48*s* is passed through the aperture 49 in the new support plate 40** and threaded into the end of the fastening bolt. The new support plate now is assembled. The reverse of the above procedure is followed to remove a module.

A switch 80 is inserted between the new support plate and the last assembled one, and a keeper clip 90 is inserted to hold the switch in position. It may be noted here that the plastic keeper clips 90 also serve as insulating shields or guards between the electrical terminals of the switches and the cam assemblies. These insulating shields are useful when a person is adjusting the settings of the cam assemblies.

To adjust the setting of a cam assembly, the setting drum 24 is turned until the zero position on the dial is under the pointer 26. The numerals on the dial run from 0 to 100, which indicates the percentage of one complete rotation of a cam assembly. The setting drum 24 is rotated to the angular position at which it is desired that the switch be actuated. With the aid of a screw driver, one side of the cam assembly is rotated until the low-to-high transition of the cam causes the switch to actuate. The setting dial then is rotated to the position where it is desired that the switch be returned to its unactivated position. Then the other half of the cam assembly is rotated until its high-to-low transition allows the switch actuator button to return to its outermost position. Successive cam assemblies are independently adjusted in the same manner.

Other types of cam assemblies may be used without departing from the teachings of the present invention.

As seen in FIG. 1, each support plate 40, as well as partial support plate 30, includes an angled bracket 105 which serves to support the assembly of modules on a mounting surface, if desired.

As illustrated in FIG. 2, a wedge 107 is molded between stop 74 and detent 75, and a second wedge 108 is molded in the U-shaped stop 77. Followers 82 and 83 on switch 80 tend engage wedges 107 and 108 when the switch is in its inserted position, thus further aiding to hold the switch in a fixed position with respect to cam assembly 50. Wedges 107 and 108 are optional but help to minimize dimensional tolerances on support plates 40.

In its broader aspects, this invention is not limited to the specific embodiment illustrated and described. Various changes and modifications may be made without departing from the inventive principles herein disclosed.

What is claimed is:

1. In a modular time sequence controller the combination comprising a first rotatable switch actuator means including an axle having an axle interlock means on at least one end thereof, means for rotating said axle, a first switch having an actuator, means for mounting said switch proximate said first rotatable switch actuator in position to be actuated during rotation of the switch actuator means, a pair of support plates, bearing means in each support plate for rotatably supporting an axle, spacer and fastening means for maintaining said support plates in spaced parallel relationship with said bearing means in axial alignment, said first rotatable switch actuator means having its end with the interlock means thereon rotatably supported by the bearing means of the first one of said support plates, a second rotatable switch actuator means including a second axle which has axle interlock means on each end thereof, said second rotatable switch actuator means being positioned between the parallel support plates with one end of its axle locked with the axle of the first switch actuator means and its other end rotatably supported by the bearing means of the second support plate, a second switch having a housing and an actuator extending therefrom, guide means on at least one of the facing surfaces of the parallel support plates, said guide means being adapted to slidingly receive said second switch housing and to position the second switch between said support plates with its actuator proximate the second rotatable switch actuator means, whereby the actuator means may actuate the second switch, detent means on at least one of the facing surfaces of the parallel support plates, detent engaging means on said second switch housing engageable with said detent means, and keeper means insertable transversely between said support plates and engageable with said second switch housing for urging said detent engaging means into a retaining engagement with the detent means while the keeper means is in place.

2. The combination claimed in claim 1 wherein said guide means are on both faces of each support plate, whereby a switch is slidingly received by a pair of guide means on respective facing surfaces of a pair of parallel support plates.

3. The combination claimed in claim 2 wherein said guide means extend outwardly from the facing surfaces of a pair of support plates, and wherein said detent engaging means extend outwardly from a switch housing and slide on said outwardly extending guide means.

4. The combination claimed in claim 3 wherein said detent means is a raised protrusion on said guide means on each face of a support plate, and further including stop means associated with each guide means for stopping the insertion of said second switch at its desired position proximate said second rotatable switch actuator means, said detent means being located to hold a detent engaging means on the second switch against said stop means when the switch is in its inserted position.

5. The combination claimed in claim 4 wherein said keeper means exerts a force on said switch to keep said detent engaging means between said stop means and said detent means.

6. In a modular time sequence controller the combination comprising motor means, a shaft rotatable in response to said motor means, a rotatable cam that includes switch actuator means and an axle of given length, axle interlocking means at each end of said axle for interlocking adjacent axially aligned axles, a pair of cam support plates, an aperture in each support plate for providing bearing means for one end of an axle of a cam, spacer and fastening means for maintaining said support plates in spaced parallel relationship with said apertures in axial alignment, said cam being positioned between said plates with at least one end received in an aperture in a first one of said plates, means in registration with the aperture in the other of said plates for coupling said axle to said shaft, whereby said cam is rotated by said motor, a switch having a housing and an actuator extending therefrom, one or more follower means on said switch housing, first and second guide means disposed, respectively, on facing surfaces of the parallel support plates and disposed adjacent the peripheries of said plates, said guide means being constructed to receive said follower means of a switch housing and to position the switch actuator proximate the switch actuator means of said cam, whereby said cam may actuate said switch, detent means associated with said guide means, said detent means being adapted to permit a switch housing to be freely inserted between said support plates along said guide means and adapted to receive said follower means on said switch housing, keeper retainer means associated with each of said support plates, keeper means insertable transversely between the keeper retainer means on the two facing surfaces of said parallel support plates and engageable with said switch housing for forcing said follower means on the switch housing into a retaining engagement with said detent means, thereby to prevent easy withdrawal of the switch housing from between the support plates while the keeper means is in place.

7. In a modular time sequence controller the combination comprising a motor mounting means for mounting a timing motor thereon, a rotatable shaft, clutch means for coupling said motor to the shaft, a plurality of substantially identical support plates each having an axle bearing means therein, spacer means of given length extending from one face of each support plate, said support plates being arranged in parallel relationship with the spacer means defining the spacing between adjacent plates and with the bearing means of the plates in axial alignment, a plurality of axially aligned fastening means each extending between a pair of adjacent parallel plates and each having a fastener at each end thereof, an aperture in each support plate for permitting the fastener at one end of a fastening means to be secured to an end of a fastener on a fastening means located between the next pair of adjacent plates, a plurality of cam means each having an axle with interlock means at each end thereof, a first one of said cam means having one end of its axle rotatably supported in the bearing means of a first one of said plates, means for coupling the other end of the axle of the first cam means to said shaft, each of the remainder of cam means being disposed between a respective pair of support plates with at least one end of its axle supported in a bearing means and with both ends of its axle interlocked with axles of cams located between adjacent pairs of plates, whereby said cam means are rotated together by said motor, a plurality of switch housings each having a switch actuator and follower means, switch guide means on the facing surfaces of each pair of support plates for slidably receiving a switch that is inserted between a pair of plates, said guide means including stop means for positioning the actuator of each switch in operable proximity to a respective cam, detent means associated with the guide means on at least one face of each pair of support plates and adapted to receive a follower means on a switch, clip receiving means on the facing surfaces of each pair of support plates, a plurality of clips each adapted to be inserted into and yieldably held in said clip receiving means between a respective pair of support plates, each clip engaging a respective switch housing for forcing the follower means of the switch into a retaining engagement with respective detent means while the clip is in its inserted position.

8. A modular construction for a switch and switch actuator means for use in a time sequence controller, comprising a pair of substantially identical support plates, spacer means of given length extending from one face of each support plate, spacer receiving means on the other face of each plate for receiving and positioning a spacer means, said spacer means and spacer receiving means of each plate being in alignment on an axis transverse to said faces of said plate, a bearing aperture in each plate, a fastening aperture in each plate, said plates being disposed in spaced parallel relationship with the spacer means of one plate received in the spacer receiving means of the other plate and with the bearing apertures and fastening apertures of the plates in respective axial alignment, a rotatable cam having an axle with axle interconnecting means at each end thereof supported between the bearing apertures of said plates, plate fastening means extending between the fastening apertures in the two plates, said fastening means having fasteners on each end thereof and at least one of the fasteners extending through the fastening aperture in one of said plates, guide bosses on the facing surfaces of said plates for receiving and guiding a switch housing into a desired position between said plates, a switch having a housing and an actuator extending from said housing, guide follower means extending outwardly from opposite sides of said housing, detent means associated with the guide bosses for retaining said follower means when the follower is moved into engagement therewith, said follower means being received by the guide bosses to guide the switch to the desired position where the actuator is in operable relationship with said rotatable cam, keeper receiving means on the facing surfaces of said plates, a keeper clip transversely insertable between said plates and having means yieldably engageable with the keeper receiving means, means on said keeper clip for engaging the switch housing and urging the follower means into a keeping engagement with said detent means while the clip is in its inserted position.

* * * * *